US007912229B2

(12) United States Patent
Noro et al.

(10) Patent No.: US 7,912,229 B2
(45) Date of Patent: Mar. 22, 2011

(54) ARRAY DRIVING SYSTEM AND METHOD OF DRIVING LOADS

(75) Inventors: Masao Noro, Hamamatsu (JP); Shin Ito, Hamamatsu (JP)

(73) Assignee: Yamaha Corporation, Hammamatsu-shi (JP)

( * ) Notice: Subject to any disclaimer, the term of this patent is extended or adjusted under 35 U.S.C. 154(b) by 914 days.

(21) Appl. No.: 10/785,587

(22) Filed: Feb. 24, 2004

(65) Prior Publication Data

US 2004/0189557 A1 Sep. 30, 2004

(30) Foreign Application Priority Data

Feb. 28, 2003 (JP) ..... P.2003-053347

(51) Int. Cl.
*H04R 1/02* (2006.01)

(52) U.S. Cl. ..... 381/89; 381/97; 381/120; 381/28; 381/387

(58) Field of Classification Search ..... 381/300, 381/111, 120, 28, 61, 27, 97, 89.335, 89, 381/335, 332, 116–117, 387
See application file for complete search history.

(56) References Cited

U.S. PATENT DOCUMENTS

| | | | | |
|---|---|---|---|---|
| 4,382,157 | A * | 5/1983 | Wert, Jr. | 381/303 |
| 4,503,554 | A * | 3/1985 | Davis | 381/28 |
| 5,414,774 | A * | 5/1995 | Yumoto | 381/1 |
| 6,128,395 | A * | 10/2000 | De Vries | 381/387 |
| 6,181,796 | B1 * | 1/2001 | Johnson | 381/28 |
| 6,263,083 | B1 * | 7/2001 | Weinreich | 381/97 |
| 6,784,096 | B2 * | 8/2004 | Chen et al. | 438/637 |
| 7,251,333 | B2 * | 7/2007 | Risch et al. | 381/27 |
| 2001/0010482 | A1 * | 8/2001 | Oki et al. | 330/10 |
| 2002/0131611 | A1 * | 9/2002 | Hoover et al. | 381/123 |
| 2003/0198358 | A1 * | 10/2003 | Hoover et al. | 381/123 |
| 2004/0008848 | A1 * | 1/2004 | Krochmal et al. | 381/55 |

FOREIGN PATENT DOCUMENTS

| | | | |
|---|---|---|---|
| DE | 3416494 | A1 | 6/1990 |
| EP | 0 935 229 | A1 | 8/1999 |
| EP | 1 263 130 | A2 | 12/2002 |
| EP | 1 263 130 | A3 | 7/2003 |
| EP | 1 624 718 | A1 | 2/2006 |
| JP | S57-131079 | U | 2/1981 |
| JP | 59-004300 | | 1/1984 |
| JP | H01-93896 | U | 12/1987 |

(Continued)

OTHER PUBLICATIONS

Notification of Reason for Refusal for patent application No. 2003-053347, dated Nov. 20, 2007.

(Continued)

*Primary Examiner* — Devona E Faulk
*Assistant Examiner* — Disler Paul
(74) *Attorney, Agent, or Firm* — Pillsbury Winthrop Shaw Pittman LLP

(57) ABSTRACT

Power amplifies are provided to correspond with a plurality of speaker units constituting a speaker array. Driving signals from the power amplifies are supplied to one terminals of the speaker units, and other terminals are connected a common line. Inverters are provided at preceding stages of the power amplifies such that the driving signals supplied to the speaker units being arranged adjacently have an opposite phase respectively. Since a correlation between the driving signals of the adjacent speaker units is high, a current flowing through the common line can be very reduced. An LED display panel can be driven by the similar method.

6 Claims, 3 Drawing Sheets

FOREIGN PATENT DOCUMENTS

| | | |
|---|---|---|
| JP | 03-159500 | 7/1991 |
| JP | 04-250710 | 9/1992 |
| JP | 05-344598 | 12/1993 |
| JP | 07-154893 | 6/1995 |
| JP | 09-046787 | 2/1997 |
| JP | 09-102996 | 4/1997 |
| JP | 09/233588 | 5/1997 |
| JP | 10-051891 | 2/1998 |
| JP | 2001-016675 | 1/2001 |
| JP | 2001-061196 | 3/2001 |
| JP | 2001-285985 | 10/2001 |
| JP | 2002-277532 | 9/2002 |
| WO | WO 01/26412 A2 | 4/2001 |
| WO | WO 01/26412 A3 | 4/2001 |
| WO | WO 01/39547 A1 | 5/2001 |

OTHER PUBLICATIONS

State Intellectual Property Office of P.R. of China First Office Action (Appln. No. 200410007078.2) Dated May 11, 2007.

European Patent Office: European Search Report for Application No. 04004235.0-1224, dated Dec. 30, 2008, (5 pgs.).

* cited by examiner

ARRAY DRIVING SYSTEM AND METHOD OF DRIVING LOADS

BACKGROUND OF THE INVENTION

The present invention relates to an array driving system for driving loads arranged like an array such as a speaker array, an LED dot matrix display, or the like, and a method of driving the loads.

As the system for driving the loads that are arranged like a one-dimensional or two-dimensional array, there are the speaker array, the LED dot matrix display, and so forth.

In the speaker array, for the purpose of the sound directivity control, etc., a number of, e.g., several hundreds of speaker units are arranged on the plane and driven.

In such speaker array, since respective speaker units must be driven by different signals, the amplifiers are needed as many as the speaker units and wirings of the twice of number of speaker units are needed between these amplifiers and the speaker units. For example, when 240 speaker units, i.e., vertical 12 columns×lateral 20 rows, are used in total, 240 amplifiers (240 ch) are needed and thus the number of wirings provided between the amplifiers and the speaker units is extremely increased.

Therefore, the speaker driving system in which the power supplying function portions are provided to an axis of abscissa and an axis of ordinate of the matrix, in which the speakers are arranged, respectively has been proposed (Patent Literature 1).

According to this proposed system, it is feasible to drive the m·n speakers of the m×n matrix by the m+n power supplying function portions.

Patent Literature 1

JP-A-2001-61196

As described above, since the speaker array of the m×n matrix is driven by the m+n power supplying function portions, the number of wirings provided to respective speaker units can be reduced and the number of power amplifiers can be reduced.

However, the currents fed from a plurality of speakers belonging to the row flow into each row wiring connected to the ground, and therefore an amount of flowing current is increased. As a result, a potential due to an impedance (ideally this impedance is 0, but actually an infinitesimal impedance is present) of the wiring is generated, and there existed the problem that the good speaker characteristic cannot be obtained. The driving circuits capable of supplying a large current to cause the speakers to suck the current thereinto are needed.

The similar situation is generated in the dot matrix display in which a plurality of LEDs are arranged like an array, or the like. In other words, when the LEDs arranged in a matrix fashion are driven, the currents fed to a plurality of LEDs that belong to each row are flown into the row wiring, so that the driving circuits capable of supplying a large current are needed.

SUMMARY OF THE INVENTION

Therefore, it is an object of the present invention to provide an array driving system capable of driving loads arranged like an array with good characteristic and making unnecessary driver circuits that can supply a large current, and a method thereof.

It is another object of the present invention to provide a speaker array driving system capable of driving speaker units as the loads arranged like an array with good characteristic and making unnecessary the driver circuits that can supply the large current.

In addition, it is still another object of the present invention to provide an LED dot matrix display driving system capable of making unnecessary the driver circuits that can supply the large current when the loads arranged like an array are composed of LEDs.

In order to solve the aforesaid object, the invention is characterized by having the following arrangement.

(1) An array driving system for driving a plurality of loads comprising:
- the plurality of loads arranged like an array; and
- a plurality of driving circuits provided to correspond with the plurality of loads, respectively,
- wherein one terminals of the plurality of loads are respectively connected to corresponding outputs of the plurality of driving circuits and the other terminals thereof are connected each other, and
- wherein driving signals are respectively supplied to the plurality of loads so that a phase of the driving signal supplied to one of the plurality of loads is opposed to that of the driving signal supplied to the adjacent loads.

(2) The array driving system according to (1), wherein the other terminals of the plurality of loads connected each other are grounded.

(3) The array driving system according to (1), wherein
- the plurality of loads include a plurality of speaker units,
- the plurality of driving circuits include a plurality of amplifiers, and
- the plurality of speaker units are connected to the plurality of amplifiers, respectively, such that the adjacent speaker unit have an opposite polarity mutually.

(4) The array driving system according to (3), wherein a plurality of inverters are connected to the corresponding amplifiers, respectively, so as to invert phase of input signals supplied to the corresponding amplifiers.

(5) The array driving system according to (1), wherein
- the plurality of loads include a plurality of LEDs;
- anodes and cathodes of adjacent LEDs are alternatively connected to a common line,
- ones of the plurality of driver circuits are connected between the anodes of the LEDs, cathodes of which are connected to the common line, and a positive power supply, and
- the others of the plurality of driver circuits are connected between the cathodes of the LEDs, anodes of which are connected to the common line, and a negative power supply.

(6) A method of driving a plurality of loads which are arranged like an array, the method comprising the steps of:
- respectively supplying driving signals to the plurality of loads so that a phase of the driving signal supplied to one of the plurality of loads is opposed to that of the driving signal supplied to the adjacent loads.

BRIEF DESCRIPTION OF THE DRAWINGS

FIGS. 2A and 2B are block diagrams showing a configurative example of an LED array driving system as a second embodiment of the array driving system of the present invention, wherein FIG. 1A is a view showing an overall configuration, and FIG. 2B is a view explaining connections between LED driving drivers and LEDs.

DETAILED DESCRIPTION OF PREFERRED EMBODIMENTS

Figure 1:
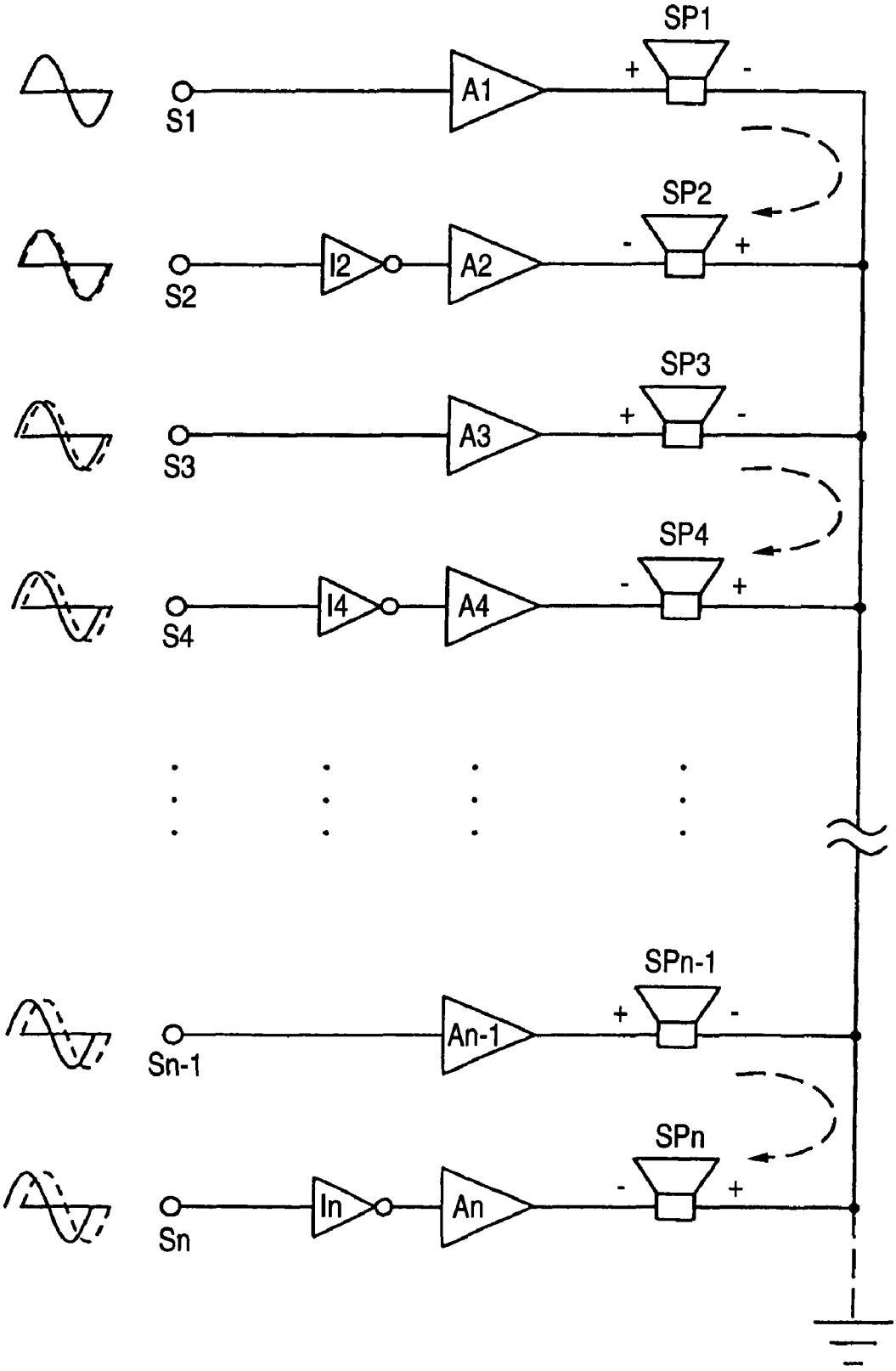
FIG. 1 is a block diagram showing a configurative example of a speaker array driving system as a first embodiment of an array driving system of the present invention.

FIG. 1 is a block diagram showing a configuration of a speaker array driving system according to a first embodiment of the present invention.

In this FIG. 1, reference sign SP1 to SPn (n is an integer of 2 or more) denote n speaker units arranged like a one-dimensional or two-dimensional array, and reference sign A1 to An denote n power amplifiers provided to correspond to the speaker units SP1 to SPn respectively and supply driving signals to corresponding speaker units SP1 to SPn. One terminal of the speaker units SP1 to SPn are connected to corresponding outputs of the power amplifiers A1 to An, while the other terminals are connected commonly and grounded. Reference sign I2, I4, . . . , In denote inverters provided on the input side of the power amplifiers A2, A4, . . . , An. The driving signals being output from the power amplifiers A2, A4, . . . , An, to which the inverter is provided respectively, to the corresponding speaker units are set in an opposite phase to the driving signals being output from remaining power amplifiers A1, A3, . . . , An−1, to which the inverter is not provided respectively.

Where, assume that the speaker units (SP1 and SP2, SP3 and SP4, . . . , SP2*k*−1 and SP2*k*, . . . , SPn−1 and SPn) to which adjacent suffices are affixed are arrange in physically adjacent positions in the array.

More particularly, in the present invention, the speaker units arranged in the physically adjacent positions are constructed such that the driving signals having an opposite phase mutually are supplied to them. Then, in order to set final acoustic outputs in the same phase, the adjacent speaker units are connected in such a manner that their polarities are in opposite phase mutually. That is, as shown in FIG. 1, plus-side terminals of the speaker units SP1, SP3, . . . SPn−1 to which the inverters are not connected are connected to the outputs of the corresponding power amplifiers A1, A3, . . . An−1 respectively, while minus-side terminals thereof are connected commonly. In contrast, minus-side terminals of the speaker units SP2, SP4, . . . , SPn to which the inverters are connected are connected to the outputs of the corresponding power amplifiers A2, A4, . . . , An respectively, while plus-side terminals thereof are connected commonly. Accordingly, phases of the acoustic signals being output from the speaker units that are driven by the driving signal in the opposite phase respectively are set equal to phases of the acoustic signals being output from other speaker units.

As well known, in case the directivity control to aim at an acoustic lens effect is carried out by the speaker array, the sound waves are concentrated upon a desired point in the space by applying the driving signals, to which a predetermined delay is given respectively, to a number of speaker units SP1 to SPn. In this case, since the speaker units located in the adjacent positions in the speaker array are physically positioned in close vicinity to each other, phase differences between these driving signals are small and thus a correlation between the driving signals becomes very high.

In the configuration shown in FIG. 1, an input signal from an input terminal S1 is amplified by the power amplifier A1, then input into a plus-side terminal of the speaker unit SP1, and then flown into the ground via a minus-side terminal of the unit SP1 (in the case the input signal is positive), so that the speaker unit SP1 is driven. An input signal from an input terminal S2 is supplied to the power amplifier A2 via the inverter I2. In this case, since the power amplifier A2 is set in the opposite phase, a current flows from the ground along a plus-side terminal of the speaker unit SP2, a minus-side terminal of the unit SP2, and the power amplifier A2. At this time, since a correlation between the input signal of the terminal S1 and the input signal of the terminal S2 is high, most of the current flows as indicated by a broken line in FIG. 1 and only a current equivalent to a difference between the input signal of the terminal S1 and the input signal of the terminal S2 flows into the ground. This is similarly true of the connections between the terminals S3 and S4, S5 and S6, . . . , Sn−1 and Sn. After all, the current flowing into the ground is given as a total sum of the differences between the driving signals in the adjacent speaker units and is very small. As a result, a ground potential generated by wiring impedances becomes small and thus the good characteristic can be expected.

As described above, since it can be expected that the current flowing into the ground becomes very small, the problem in no means arises particularly even though a line to which terminals of the speaker units SP1 to SPn, which are not connected to the power amplifiers, are connected commonly (common line) is not connected to the ground, as indicated by a broken line in FIG. 1. Therefore, it is possible that a common line to which the other terminals of a plurality of speaker units are connected commonly should not be connected to the ground. In this case, the wirings provided between the power amplifiers and the speaker units can be reduced to the number (n) corresponding to the number of the speaker units, and thus the number of wirings can be reduced much more.

As described above, according to the array driving system of the present invention, the driving signals can be supplied to respective speaker units via one wiring, and the earth wire can be used in common to all speaker units. Therefore, only (n+1) wirings are required of n speaker units, and the number of wirings can be reduced.

In case the common line to which respective speaker units are connected commonly is not connected to the ground, only one wiring is required every speaker unit.

In addition, since the adjacent speaker units are driven by the driving signals having the opposite phase, the current flowing through the earth wire to which respective speaker units are connected commonly can be reduced very small and degradation of the characteristic due to the earth potential that is generated by the wiring impedance can be prevented.

In this case, if a plurality of speaker units are fixed to a baffle to put a metal plate therebetween, it can be implemented simply to connect the other terminals of respective speaker units commonly.

In the above, explanation is made where n is the even number. In the case that n is large (e.g., several hundreds), the effect can be expected sufficiently if n is the odd number.

In the embodiment explained up to now, a plurality of speaker units in the speaker array are driven. The array driving system of the present invention can be applied to the case that the LEDs are driven in the LED display panel.

Another embodiment of the present invention to drive the LEDs in the LED display panel will be explained hereinafter. Here, suppose that the LEDs are arranged in m rows and n columns.

Figure 2A:
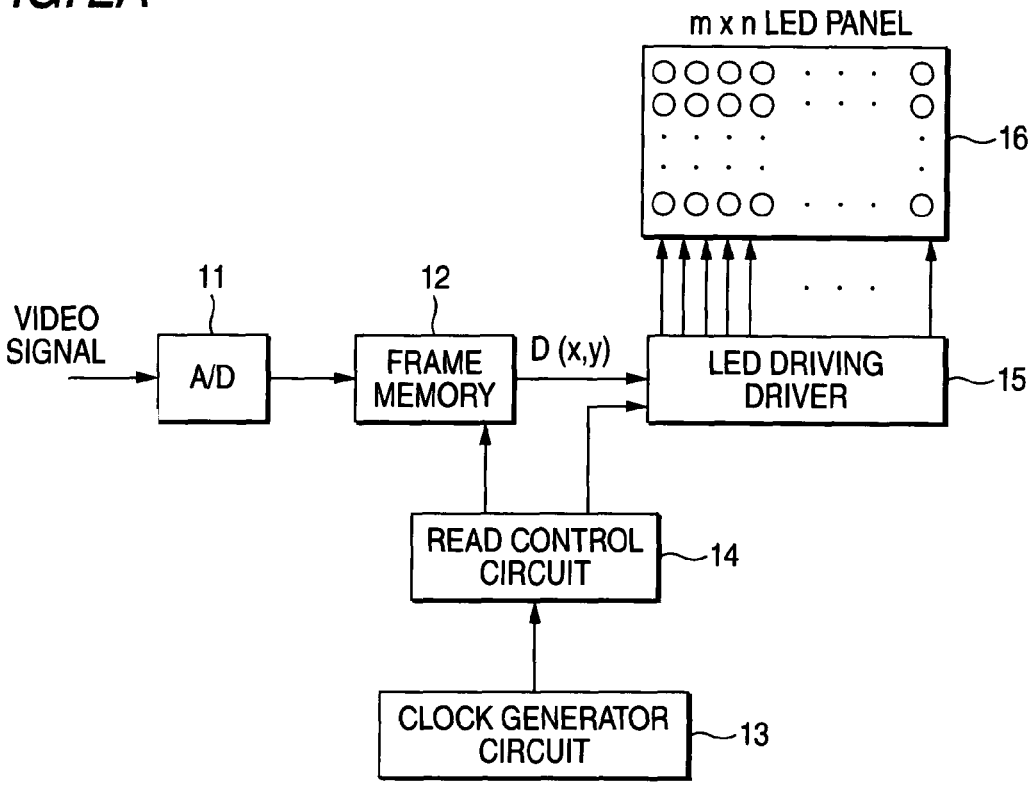

FIG. 2A is a block diagram showing a pertinent configuration of an LED array driving system in this embodiment of the present invention. In this FIG. 2A, reference numeral 11 is an A/D converter for converting the input video signal such as the NTSC signal, or the like into frame data in the form of n×m pixels, and numeral 12 denotes a frame memory for storing the frame data supplied from the A/D converter 11. Reference numeral 13 denotes a clock generator circuit for generating a read clock in a period of (1/30×1/(m×n)) when 30 frames of the image are displayed every second. Reference numeral 14 denotes a read control circuit for generating a read address of the frame memory 12 in response to the read clock from the clock generator circuit 13. The read address used to read the pixel data is generated sequentially from the read control circuit 14 in such a way that first the data is read sequentially from the upper leftmost pixel toward pixels on the right side and then the data is read from the leftmost pixel in the next row when the data reading comes up to the rightmost pixel in this row. Accordingly, image data of corresponding pixels are read from the frame memory 12, and supplied to corresponding driver circuits of LED elements in an LED driving driver 15.

The driver circuits for supplying the driving current in correspondence to m×n LEDs arranged in an LED display panel 16 respectively are provided to the LED driving driver 15. Each driver circuit has a memory element for storing the image data read from the frame memory 12 corresponding to the pixel, and a driving circuit for supplying the current corresponding to a value of the image data to the corresponding LED. In this case, the color display is employed, the frame memory is provided every color of RGB, and the m×n LEDs are provided to each color respectively.

Figure 2B:
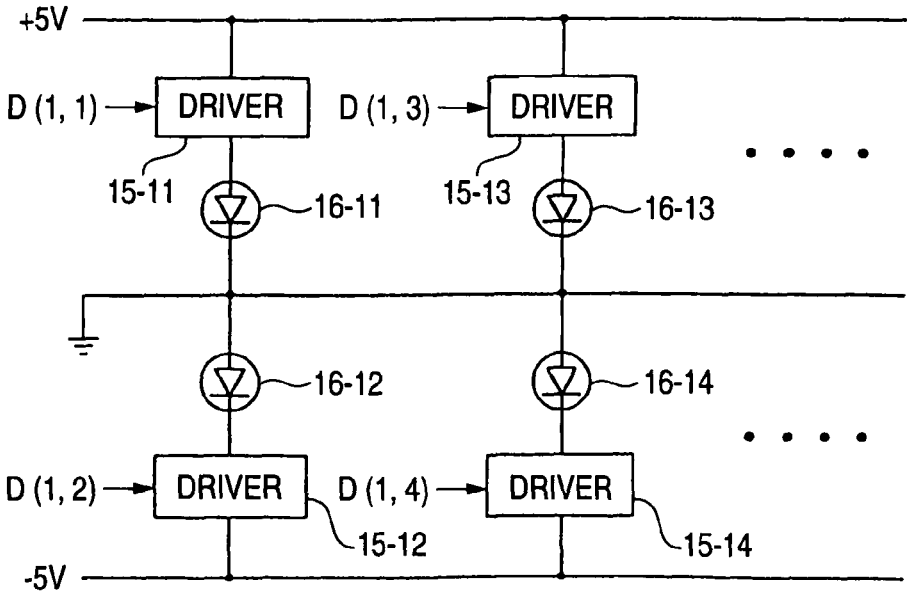

FIG. 2B is a view showing a fashion of connections between the LED driving driver 15 and the LEDs contained in the LED display panel 16. As shown in FIG. 2B, in the LED array driving system of the present invention, adjacent LEDs are driven by different polarities. In more detail, an LED (16-11) in the first row and the first column and a driver circuit 15-11 for driving the LED, an LED (16-13) in the first row and the third column and a driver 15-13 for driving the LED, . . . are connected in series between a positive power supply voltage (+5 V) and the ground, while an LED (16-12) in the first row and the second column and a driver 15-12 for driving the LED, an LED (16-14) in the first row and the fourth column and a driver 15-14 for driving the LED, . . . are connected in series between the ground and a negative power supply voltage (−5 V).

In this manner, in the present invention, the LEDs (15-11), (15-13), . . . in the odd columns are driven by the currents that have a magnitude in response to the corresponding image data D (1,1), D(1,3), . . . respectively and flow from the plus power supply to the ground, while the LEDs in the even columns are driven by the currents that have a magnitude in response to the corresponding image data respectively and flow from the ground to the minus power supply. Namely, the LED array driving system of the present invention is constructed such that adjacent LEDs are driven by the opposite polarities.

Figure 3A:
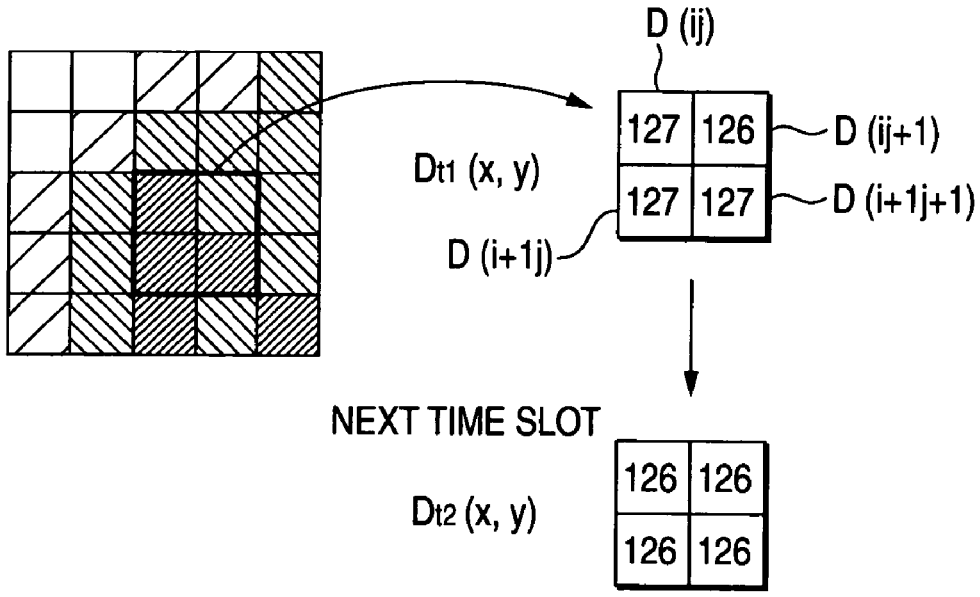
FIGS. 3A and 3B are views explaining an operation of the embodiment shown in FIGS. 2A and 2B.

An operation of the LED array driving system of the present invention constructed in this manner will be explained with reference to FIGS. 3A and 3B hereunder.

Normally, in the image data, the pixel value is not independent of the neighboring pixel and has the similar value in most cases. When the image is represented by the gray scale, the density gradient is often present in the natural image, and adjacent pixel values have the almost same value. FIG. 3A shows an example in which one pixel is represented by 8 bits (=256 levels). In this example, the case where a level Dt1 (i,j)=127 of the pixel (i, j) and a level Dt1 (i,j+1)=126 of the adjacent pixel (i, j+1) are given at a time t1, and then a level Dt2 (i,j)=126 and a level Dt2 (i,j+1)=126 are given at a next time t2 is shown.

Figure 3B:
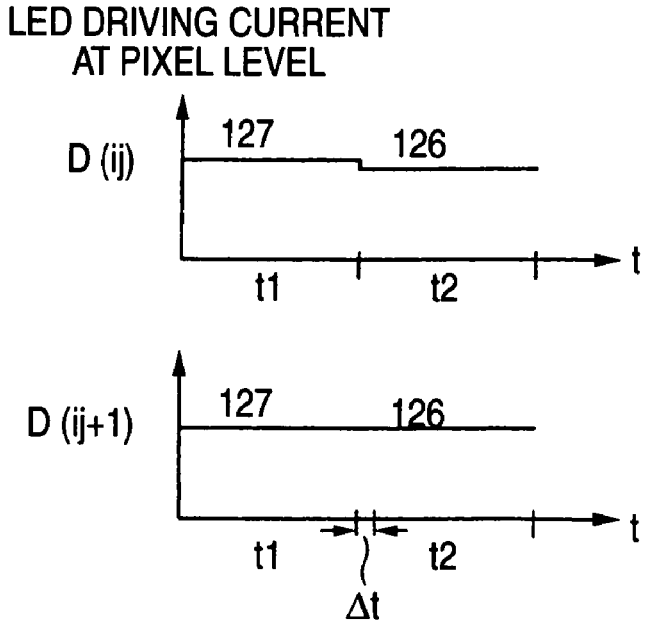

FIG. 3B is a view showing absolute values of an LED driving current supplied from the driver circuit corresponding to the pixel (i, j) and an LED driving current supplied from the driver circuit corresponding to the pixel (i,j+1).

In this example shown in FIG. 3B, a difference in the driving current between the adjacent pixels in a period t1 is a current corresponding to the pixel level 1, and this difference is eliminated in a period t2. Here, a displacement Δt=1/(30×m×n) second is generated in a start time of t2, based on a difference in times at which the pixel data are read by the read control circuit 14. But such influence is negligible.

In this manner, absolute values of the driving currents of the LEDs corresponding to the adjacent pixels are almost identical, but directions of the currents are in the opposite direction. It is possible to say that the same is true of all sets of the adjacent LEDs. In the end, it is appreciated that the current flowing through the line (common line), which connects cathodes and anodes of the LEDs in FIG. 2 commonly and is connected to the ground, can be very reduced.

In this case, since this current is very small, this common line is kept not to be connected to the ground.

The case where the circuit that has the memory element and can be driven at a duty of 100% is employed as the driver circuit is explained herein. The present invention is not limited to this case, and can be applied similarly to the case where the driver circuit for driving the LEDs by the PWM (pulse width modulation) system is used.

As described above, according to the array driving system of the present invention, since one terminals of a plurality of loads are connected commonly and adjacent loads are driven mutually in opposite phase, the current flowing through the commonly-connected portions can be very reduced and thus deterioration of the characteristic due to the common impedance can be prevented.

According to the array driving system for driving the speaker array of the present invention, above deterioration of the characteristic due to the common impedance can be prevented and the number of wirings for connecting the amplifiers and the speaker units can be reduced.

In addition, according to the array driving system for driving the LED matrix of the present invention, since adjacent LEDs can be driven mutually in opposite phase, the current flowing through the earth wire can be reduced.

What is claimed is:

1. A speaker array system comprising:

N driving circuits, N being an integer equal to or greater than 4;

a plurality of N speakers arranged in an array, each of the N speakers making up plural pairs of speakers, each pair of speakers comprising a first speaker and a second speaker, each first speaker being positioned adjacent to the second speaker in the pairs of speakers, each of the N speakers having two terminals, one of the two terminals being coupled to a corresponding one of the N driving circuits and the other of the two terminals being connected to together so that N+1 wirings are utilized in the speaker array system, wherein in each pair of speakers, the one terminals coupled to the driving circuits have opposite polarity, and the first speaker receives a first driving signal at the one terminal from the corresponding one of the N driving circuits and outputs a first current signal at the other terminal, and the second speaker receives a second driving signal, having an inverse phase and a predetermined delay relative to the first driving signal, at the one terminal from the corresponding one of the N driving circuits and outputs a second current signal at the other terminal so that a magnitude of a sum of the first current signal and the second current signal is determined by a magnitude of the predetermined delay, wherein the first driving signal received by the first speaker and the second driving signal received by the second speaker are generated from one signal.

2. The speaker array system according to claim 1, wherein the predetermined delay is used to cause an acoustic lens effect.

3. The speaker array system according to claim 1, wherein the inverse phase is provided by an inverting amplifier.

4. The speaker array system according to claim 1, wherein the array is a two dimensional array.

5. The speaker array system according to claim 1, wherein the others of the two terminals connected together are connected to ground.

6. A speaker array system comprising:

two-dimensional speaker array comprising a plurality of N speakers, N being an integer equal to or greater than 4, each of the N speakers including a signal input terminal and a common terminal;

a plurality of N driving circuits which drive the N speakers by driving signals, respectively;

N wirings which connect the signal input terminals of the N speakers to outputs of the plurality of N driving circuits, respectively;

a common wiring which connects the common terminals of the N speakers together;

a plurality of N input terminals coupled to the N driving circuits to supply input signals to the N driving circuits, respectively;

a plurality of inverters for inverting a signal, which inverters are alternately disposed between the N driving circuits and the N input terminals in a manner that a speaker of the N speakers which is connected to the inverter through the driving circuit, is arranged physically adjacent to the speaker of the N speakers which is not connected to the inverter through the driving circuit, wherein the input signals are generated from one signal, and wherein the input signals which have same components, and to which predetermined delays are given, are input to the input terminals, respectively, so that a magnitude of a difference between the driving signals in the adjacent speakers is determined by a magnitude of the predetermined delay.

* * * * *